United States Patent [19]

Milone

[11] Patent Number: 4,754,558

[45] Date of Patent: Jul. 5, 1988

[54] MATERIAL TREATMENT SYSTEM

[75] Inventor: Philip G. Milone, Burlington, Mass.

[73] Assignee: Wolverine Corporation, Methuen, Mass.

[21] Appl. No.: 74,140

[22] Filed: Jul. 16, 1987

[51] Int. Cl.[4] ..... F26B 19/00

[52] U.S. Cl. ..... 34/216; 34/225; 99/386; 99/400; 99/401; 99/443 C

[58] Field of Search ..... 34/225, 216, 155; 99/385, 386, 443 C, 443 R, 400, 401

[56] References Cited

U.S. PATENT DOCUMENTS

| | | | |
|---|---|---|---|
| 2,244,670 | 6/1941 | Benedict . | |
| 3,445,939 | 5/1969 | Malmquist | 34/225 |
| 3,646,880 | 3/1972 | Norris | 99/443 C X |
| 3,721,178 | 3/1973 | Szabrak et al. | 99/443 C X |
| 3,734,740 | 5/1973 | Zenos | 99/443 C X |
| 3,815,488 | 6/1974 | Van Dyk, Jr. | 99/443 C X |
| 3,873,755 | 3/1975 | McKay . | |
| 3,908,533 | 9/1975 | Fagerstrom | 99/386 |
| 4,112,912 | 9/1978 | Ballentine | 99/401 X |
| 4,151,791 | 5/1979 | Baker | 99/386 X |
| 4,154,861 | 5/1979 | Smith | 34/ |
| 4,326,342 | 4/1982 | Schregenberger | 34/216 X |

FOREIGN PATENT DOCUMENTS 579895 8/1946 United Kingdom .

*Primary Examiner*—Steven E. Warner

[57] ABSTRACT

A thermal treatment system includes thermally insulated housing structure in which conditioning plenum structure and distribution plenum structure are disposed. The distribution plenum is disposed adjacent a treatment zone that extends through the housing, and the side of the distribution plenum adjacent the treatment zone defines an open port region that corresponds in dimension to the length and width of the treatment zone. Seal flange structure extends along the edges of the open port region. Conveyer structure for supporting product to be thermally treated is disposed in the treatment zone in juxtaposition to the open port region of the distribution plenum. A series of sealed chamber units, each of which includes an array of nozzle tubes that provide an array of spaced parallel flow passages through the sealed chamber, close the open port region so that the series of sealed chamber units defines a wall of the distribution plenum adjacent the treatment zone. Conditioned gas from the conditioning plenum is flowed into the distribution plenum for discharge with substantial velocity toward the conveyer through the nozzle tubes of the sealed chamber units for thermal treatment of products being transported by the conveyer structure through the treatment zone. Releasable clamp structure that seats the sealed chamber units on the distribution plenum flange surfaces provides seals between the sealed chamber units and the distribution plenum seal flanges and facilitates removal and cleaning of the chamber units.

19 Claims, 4 Drawing Sheets

MATERIAL TREATMENT SYSTEM

This invention relates to material treatment systems and more particularly to systems for treating products with a gaseous medium brought into heat exchange or other treating relation therewith as the product to be treated is conveyed in a substantially horizontal direction through a treatment zone.

Manufacturers of continuous air convection dryers and cooking or baking ovens have long recognized that high velocity air impingement onto the product through nozzles with long length to open area ratios (see, for example Brown U.S. Pat. No. 3,263,339) operate at significantly higher heat transfer rates and at improved product uniformity than ovens utilizing perforated plate.

However, very often, a portion of the vapors emitted from the process will condense on the nozzles and support sheet structures due to frequent temperature excursions and harden when cooled, carbonized, etc. Condensibles such as grease from meat cooking and plasticizers from drying solvent based web coatings are particularly troublesome. Unless the build up of these materials is minimized in the product zone through frequent and thorough cleaning of the nozzle tubes or slots, support sheets and other parts, contamination will likely occur from deposits which fall onto the product or are carried by the circulating air. In meat and poultry cooking oven interior parts are usually cleaned every working day and carbonized grease deposits must usually be removed by abrasive blasting or wire brushing.

The tube or slot nozzles and support sheets are particularly difficult to clean because of the large external surface area presented by the many nozzles, their close proximity to each other and the restricted access to the areas which they are located. Removable nozzle sheet sections and/or nozzles have been furnished as a partial solution but cleaning the many parts remains a costly labor intensive procedure.

In accordance with one aspect of the invention, there is provided a thermal treatment system that includes thermally insulated housing structure in which conditioning plenum structure and distribution plenum structure are disposed. The distribution plenum structure is disposed adjacent a treatment zone that extends through the housing structure, and the side of the distribution plenum structure adjacent the treatment zone defines an open port region that corresponds in dimension to the length and width of the treatment zone. Seal flange structure extends along the edges of the open port region. Conveyer structure for supporting product to be thermally treated is disposed in the treatment zone in juxtaposition to the open port region of the distribution plenum structure, and the conveyer is moved to transport products to be treated through the treatment zone. A series of sealed chamber units, each of which includes peripheral wall structure and upper and lower tube sheet structures that are sealed to the peripheral wall structure, and an array of nozzle tubes sealed to and extending between the upper and lower tube sheet structures to provide an array of spaced parallel flow passages through the sealed chamber, are disposed along the open port region of the distribution plenum structure and close the open port region so that the series of sealed chamber units define a wall of the distribution plenum structure adjacent the treatment zone. Releasable clamp structure seats the sealed chamber units on the distribution plenum flange surfaces to provide seals between the sealed chamber units and the distribution plenum seal flanges. Conditioned gas from the conditioning plenum structure is flowed into the distribution plenum structure for discharge with substantial velocity toward the conveyer through the nozzle tubes of the sealed chamber units for thermal treatment of products being transported by the conveyer structure through the treatment zone.

In preferred embodiments, the seal flange structure extends along the sides of the open plenum region, and each sealed chamber unit extends across the width of the open region, and is seated on seal surfaces on opposite sides of the open port region so that a series of sealed chamber units are disposed along the length of the treatment zone and provide a boundry wall of the distribution plenum adjacent the treatment zone in juxtaposition with the conveyer structure.

Preferably, the peripheral wall and tube sheet structures of each sealed chamber unit are of stainless steel sheet, the upper and lower tube sheet structures are welded to the peripheral wall, and the nozzle tubes are welded to said upper and lower tube sheet structures so that a sealed enclosure is maintained. The nozzle tubes have a length that is at least four times their transverse inner flow dimension (inner diameter), and the center to center spacing of the tubes in the sealed chamber units is between two and eight times the inner flow dimension. Optionally, port structure may be included in peripheral walls of the sealed chamber units for flowing liquid into the chambers.

In a particular thermal treatment system for cooking food products such as meat or poultry, two distribution plenum structures are disposed in a thermally insulated housing structure and both are coupled to conditioning plenum structure. The distribution plenum structures are disposed above and below a treatment zone that extends through the housing structure, and the side of each distribution plenum structure adjacent the treatment zone defines an open port region that corresponds in dimension to the length and width of the treatment zone, each open port region being bounded by seal flange structure that extends along the edges of the open port regions. First and second series of sealed chamber units, each have an array of nozzle tubes sealed to and extending between upper and lower tube sheet structures to provide an array of spaced parallel flow passages through the sealed chamber, are disposed along the open port regions of the two distribution plenum structures and close the open port regions so that each series of sealed chamber units defines a wall of a distribution plenum structure adjacent the treatment zone. Releasable clamp structures seat the sealed chamber units on the distribution plenum flange surfaces to provide seals between the sealed chamber units and the distribution plenum seal flanges. Stainless steel wire belt conveyer structure transports the food products to be cooked through the treatment zone in juxtaposition to the sealed chamber units of the distribution plenum structures, and conditioned gas is flowed from the conditioning plenum into the distribution plenums for discharge with substantial velocity toward the conveyer through the nozzle tubes of the sealed chamber units for cooking products being transported by the belt conveyer through the treatment zone. The ends of the tubes of each first sealed chamber unit are substantially flush with their respective tube sheet structures, while one end of each tube of each second sealed chamber unit is flush with a tube sheet structure and the other end of each tube of each second sealed chamber unit projects beyond the other tube sheet, and above liquid contained in a reservoir region adjacent the treatment zone. Water supply manifold structure extends along one side of the treatment zone along the length thereof, and a plurality of flow passages transfer water from the distribution manifold to corresponding reservoirs of the second series of sealed chamber units. Each second sealed chamber unit further includes overflow weir structure for discharge of water, and the system includes associated transfer structure for transferring said discharge water to waste.

The system provides effective thermal treatment and its cleaning is significantly facilitated.

Other features and advantages of the invention will be seen as the following description of a particular embodiment progresses, in conjunction with the drawings, in which.

DESCRIPTION OF PARTICULAR EMBODIMENT

Figure 1:
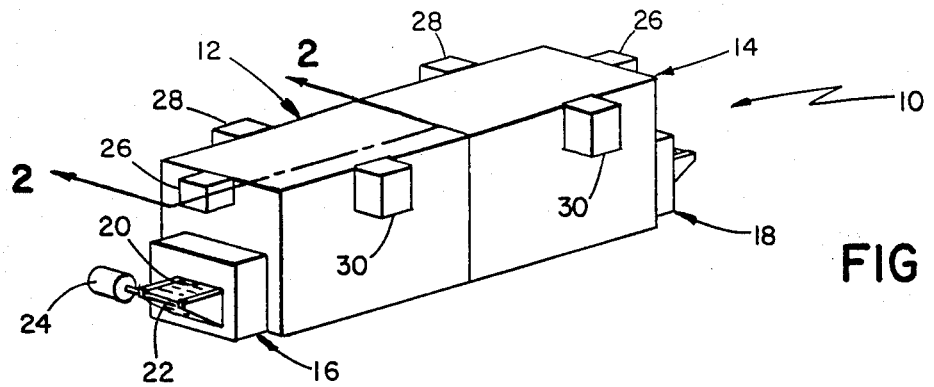
FIG. 1 is a perspective view of an oven system in accordance with the invention.

The oven system 10 shown in FIG. 1 has an overall length of about thirty six feet, a height of about eleven feet and a width of about ten feet, and includes two similar thermally insulated housing sections 12, 14, each of which is about eighteen feet long, and entrance and exit transition structures 16, 18, each with an opening 20 through which 32-inch wide stainless steel wire transport conveyer belt 22 extends for movement along a treatment zone that extends through the two oven housing sections 12, 14 as driven by drive motor 24.

Mounted on each housing section 12, 14, are a burner unit 26 and blower drive motors 28, 30 that are disposed on opposite sides of each housing section 12, 14.

Figure 2:
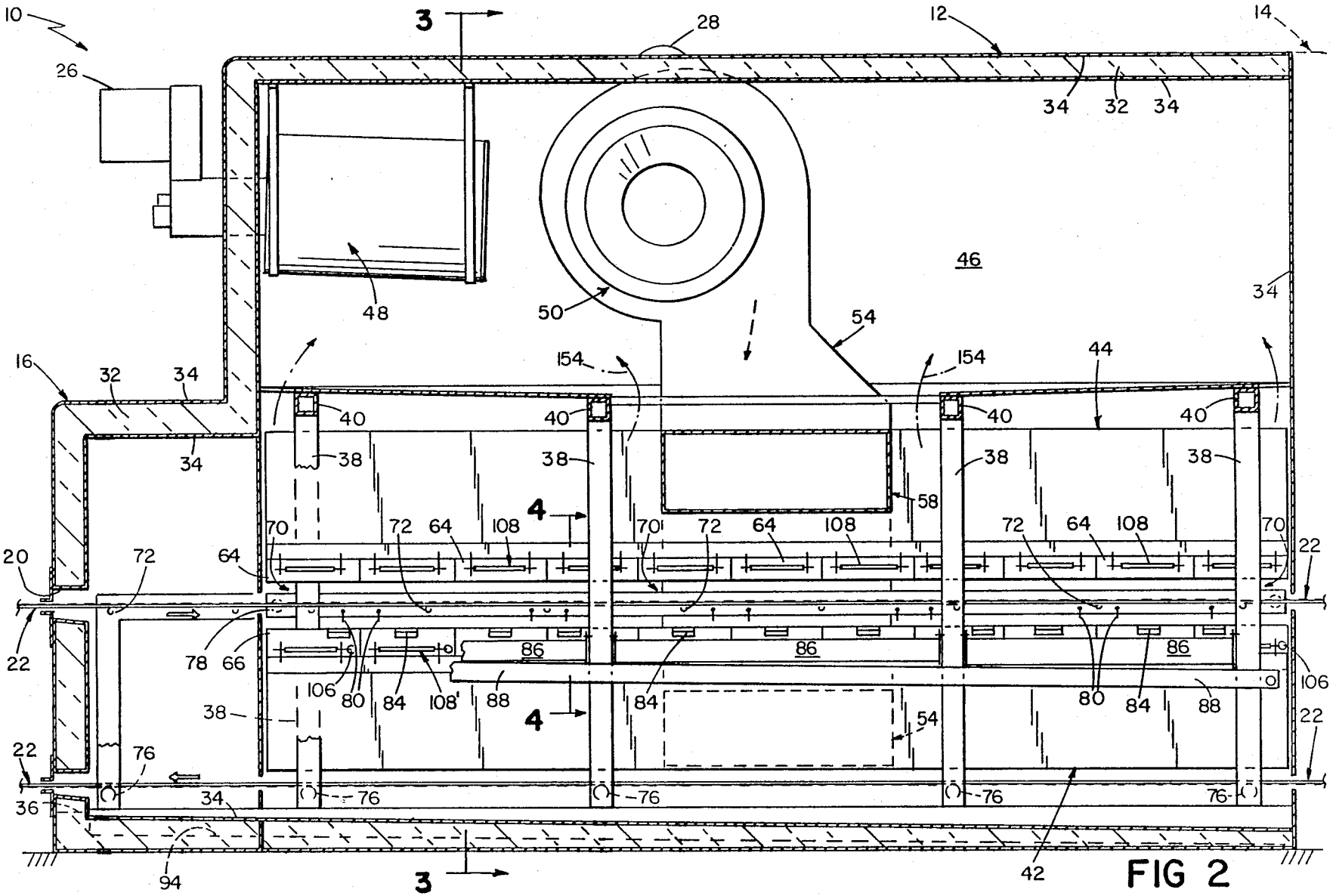
FIG. 2 is a cross-sectional view taken along the line 2—2 of FIG. 1.
Figure 3:
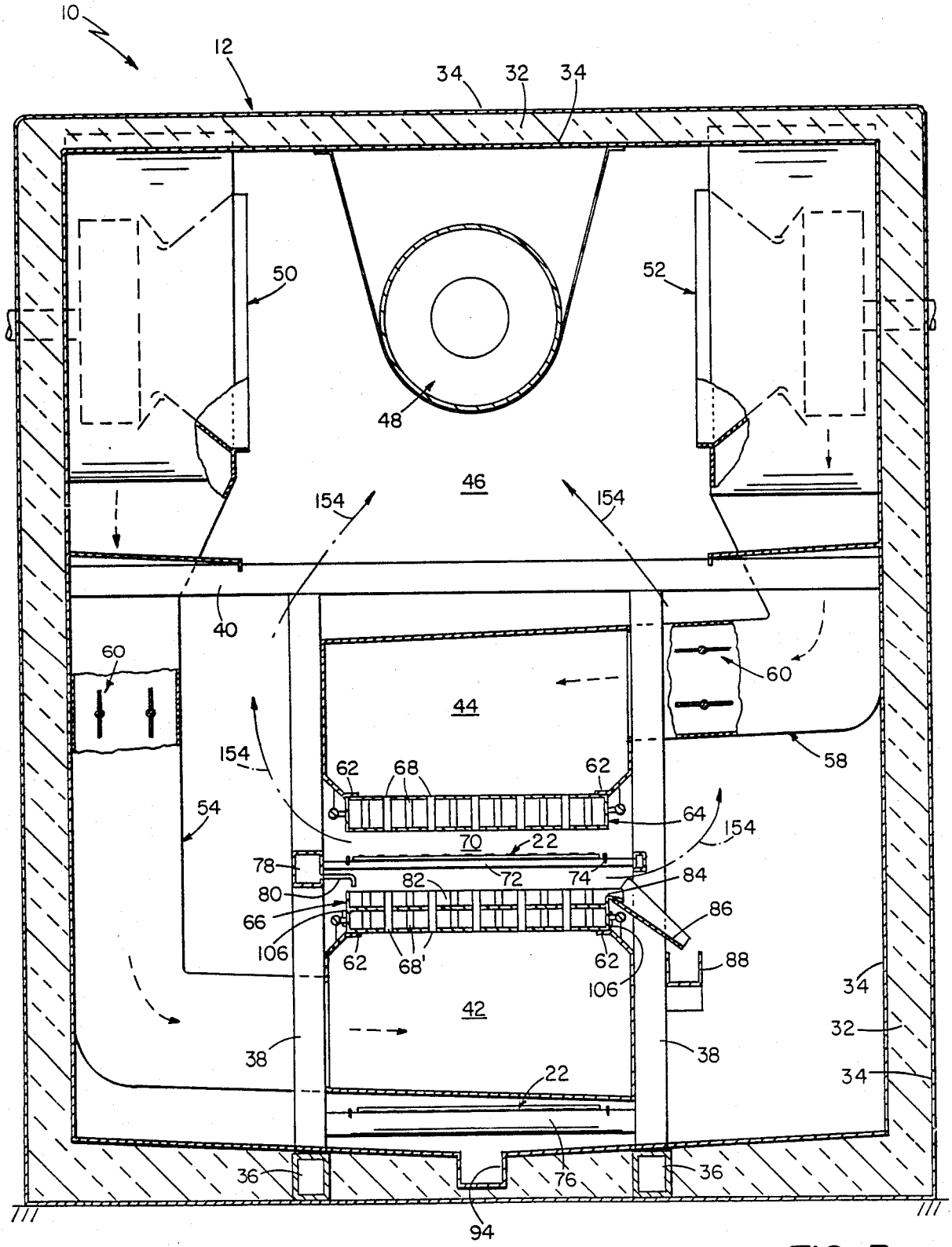
FIG. 3 is a cross sectional view taken along the line 3—3 of FIG. 2.

Further details of the oven system may be seen with reference to FIGS. 2 and 3. As indicated in those figures, thermal insulation 32 is disposed in the walls of housing sections 12, 14 and transition sections 16, 18 and covered with stainless steel sheeting 34. Formed within housing sections is a support framework that includes longitudinal base members 36, on which vertical posts 38 that are spaced along the length of the oven are mounted. Transverse beam members 40 are secured at the top of posts 38. Disposed between and secured to vertical posts 38 are stainless steel lower plenum structure 42 and stainless steel upper plenum structure 44. Formed between plenums 42, 44 is the treatment zone through which conveyer belt 22 passes. Above transverse beams 40 is conditioning plenum structure 46 in which burner tube 48 that is connected to burner 26 is disposed, together with delivery blowers 50, 52 which are coupled to drive motors 28, 30, respectively. Blower 50 flows heated gases along conduit 54 past control dampers 60 to lower distribution plenum 42; and blower 52 similarly flows heated gases along conduit 58 past control dampers 60 to upper delivery plenum 44.

The entire side of each delivery plenum structure 42, 44 facing the treatment zone is open (each plenum having an open region about three feet wide and fifteen feet long). Seal flange surfaces 62 extend along the sides of each plenum opening. A series of sealed chamber units 64 are seated on flange surfaces 62 of upper plenum 44 and a similar series of sealed chamber units 66 seated on flange surfaces 62 of lower delivery plenum 42, each chamber unit 64, 66 providing a bounding plenum surface and carrying an array of nozzle tubes 68 through which heated gases are flowed for discharge in high velocity streams into treatment zone 70 through which conveyer belt 22 extends.

As indicated in FIGS. 2 and 3, transport belt 22 passes through port 20 of insulated transition structure 16 and extends through treatment zone 70 between upper sealed chamber units 64 and lower sealed chamber units 66 as supported on fixed transverse rods 72 that carry lateral guides 74. Belt 22 extends through oven sections 12, 14 to exit transition structure 18 and then returns along the lower portion of oven sections 12 and 14 as supported on transverse tubes 76.

Water supply manifold 78 is supported on vertical posts 38 along one side of treatment zone 70 and spaced supply tubes 80 flow water from manifold 78 into reservoir portions 82 of the lower sealed chamber units 66. Each lower sealed chamber unit includes a weir 84 that controls the depth of water in chamber 82 at a depth of about one inch immediately below the transport conveyer 22 in treatment zone 70. Supported from posts 38 are a series of troughs 86 which transfer overflow water from reservoir chambers 82 to longitudinally extending drain channel 88 that extends the longitudinal length of the oven unit. The oven unit housing has stainless steel interior walls 34 and a longitudinally extending drain channel 94 is formed in the bottom of the housing.

Figure 4:
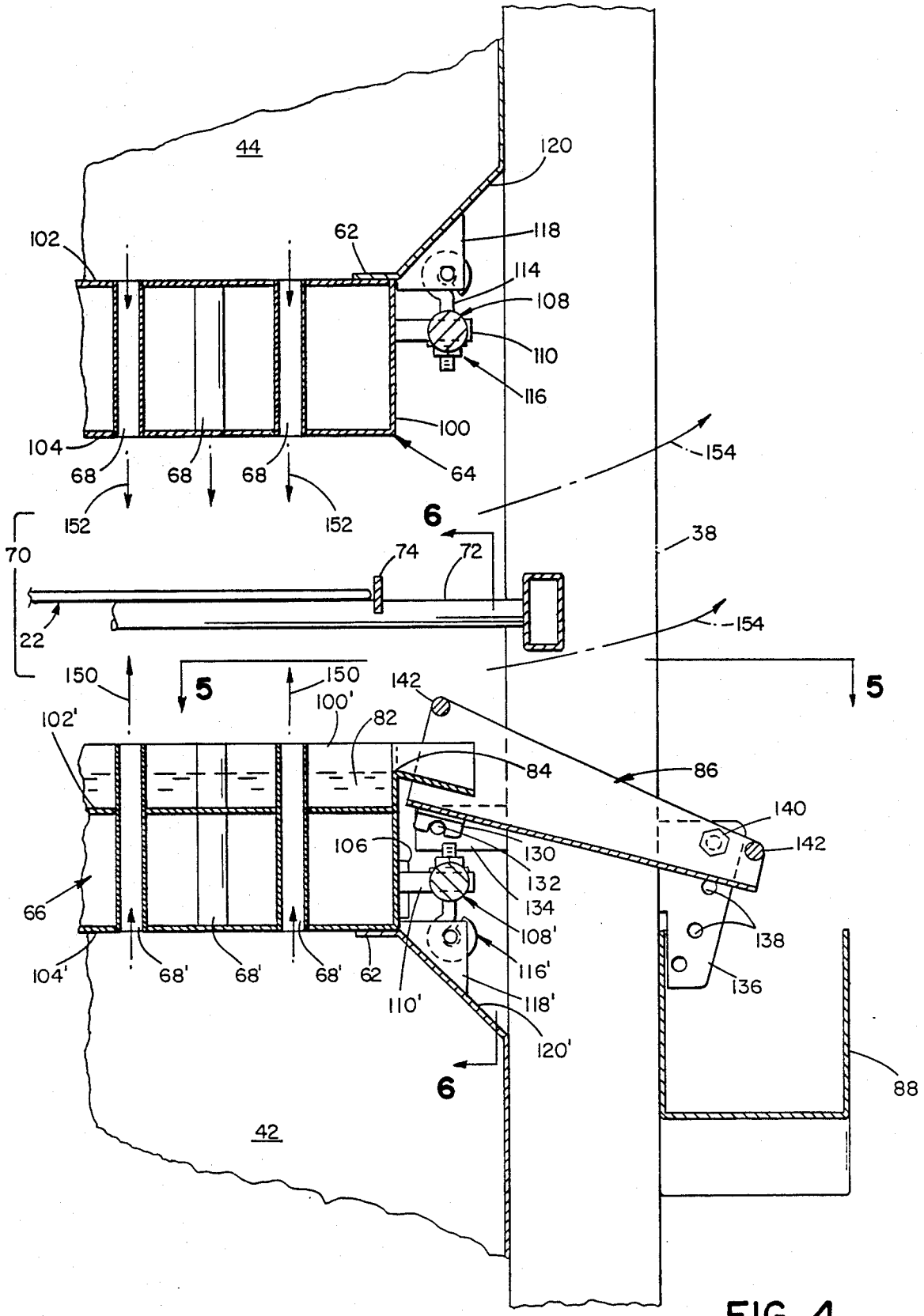
FIG. 4 is a cross-sectional view taken along the line 4—4 of FIG. 2.

Further aspects of the sealed chamber units 64, 66 and associated plenum structures may be seen with reference to FIG. 4. Upper sealed chamber unit 64 includes a stainless steel peripheral wall 100 that has a length dimension of thirty-four inches, a width dimension of sixteen inches and a height dimension of four inches. Welded to peripheral wall 100 are stainless steel upper sheet 102 and lower sheet 104 to provide a sealed chamber. Stainless steel tubes 68 that are four inches long and $\frac{3}{4}$ inch outer diameter (and about one millimeter wall thickness) are spaced about four inches on center and are welded to and extend between sheets 102 and 104 to provide multiple parallel flow passages from upper plenum 44 into treatment zone 70, the discharge ends of tubes 68 being spaced about four inches from conveyor 22. Projecting from the end walls of each sealed chamber unit 64 are handle structures 108 with associated clamp plate structures 110 that include slots 112 for receiving shanks 114 of clamp bolts 116. Bolts 116 are pivotally supported on plates 118 secured to the inclined transition surfaces 120 of plenum chamber 44. Each sealed chamber unit is seated against flanges 62 of the plenum chamber and secured in plenum chamber sealing position by clamp bolts 116.

The lower sealed chamber units 66 are similarly clamped in sealing relation on flanges 62 of lower distribution plenum 42. Each lower sealed chamber unit 66 includes a similar array of tubes 68' that are five inches long. The sealed chamber units 66 include welded stainless steel peripheral walls 100' and upper and lower chamber sheets 102' 104' that are welded to tubes 68' and to peripheral wall 100'. Tube sheets 102', 104' are spaced three inches apart so that tubes 68' extend two inches above tube sheet 102' as does peripheral wall 100'. Formed at one end of each peripheral wall is overflow weir 84 that maintains liquid depth in the reservoir 82 of the depth of about one inch. (Optional sealed port structure 106 may be provided in the chamber wall for introduction of tempering liquid into the sealed chambers if desired, for example, to reduce the temperature of surfaces on which grease may be deposited.) Similar handle and associated clamp plate mechanisms cooperate with clamp bolts 116' that are pivotally supported on plates 118' to clamp the lower sealed chamber units 66 on the flanges 62 of lower distribution plenum 42.

Figure 5:
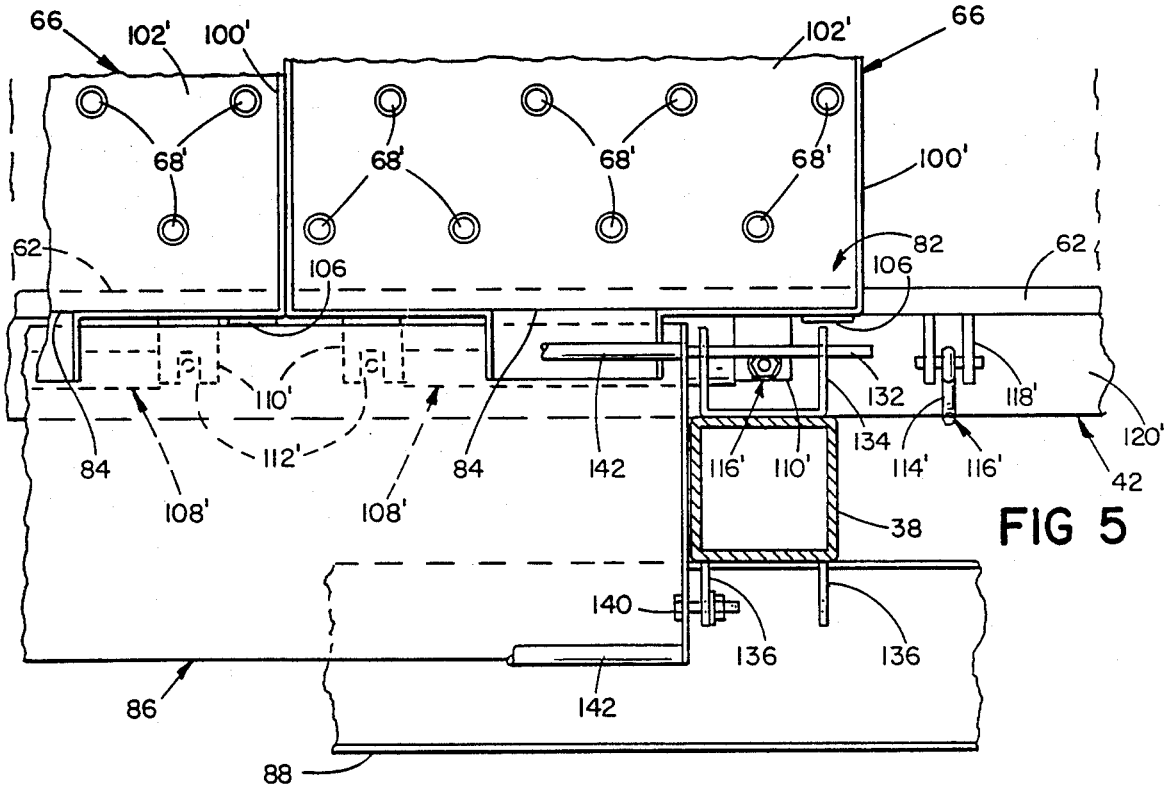
FIG. 5 is a cross-sectional view of a portion of a nozzle chamber units and support structures taken along the line 5—5 of FIG. 4.
Figure 6:
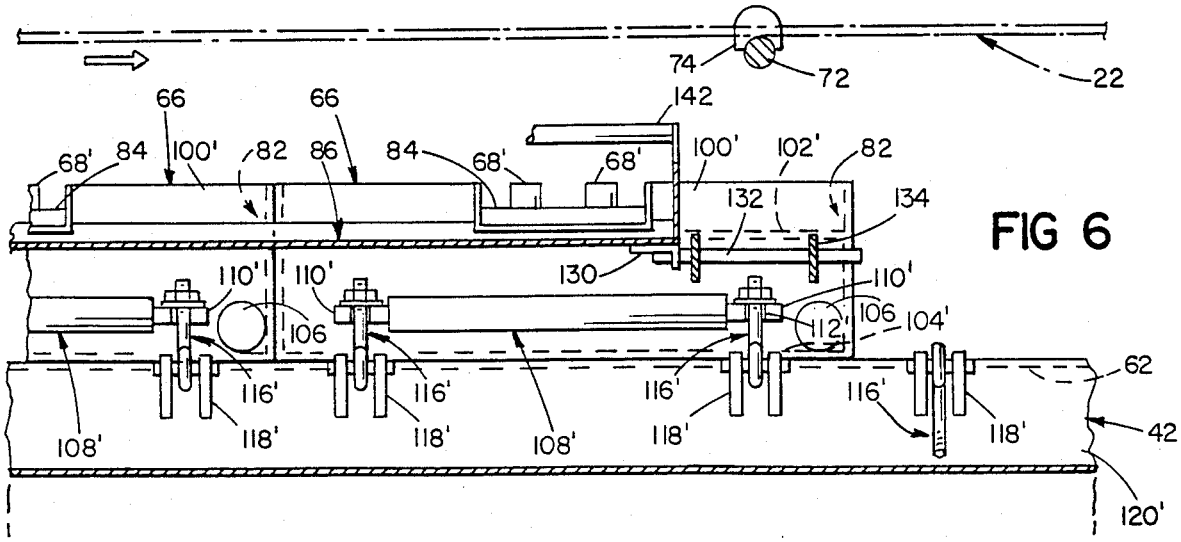
FIG. 6 is a cross-sectional view of portions of the system shown in FIG. 5 taken along the line 6—6 of FIG. 4.

As shown in FIGS. 4 and 5, each transfer trough 86 is supported between adjacent posts 38 and carries locating tabs 130 which seat on stub rods 132 carried by bracket 134 on vertical column 38. On the opposite side of each column 38 are bracket plates 136 that have a series of spaced holes 138. Bolt fasteners 140 inserted in selected bracket holes 138 secure the discharge trough 86 at a desired inclined position relative to drain channel 88. Transversly extending rods 142 at the front and rear of each transfer trough 86 serve as handles for trough removal.

In oven system operation, air heated to a temperature of about 450°–500° F. is circulated from conditioning plenum 46 by blowers 50 and 52 through conduits 54 and 58 to lower and upper distribution plenums 42, 44, respectively. That heated air is discharged from the plenums through the tubes 68, 68' of the sealed chamber units 64, 66 in parallel streams at a velocity of about 12,000 feet per minute, the upwardly flowing streams 150 from tubes 68' impacting against the bottom surfaces of conveyer 22 and products on that conveyer with effective sweeping heat transfer action. Similarly the downwardly flowing streams 152 from upper sealed chamber units 64 flow downwardly against products on conveyer 22 in effective sweeping heat transfer action. The flows of the heated gases are exhausted from either side of treatment zone 70 and flow upwardly (as indicated by arrows 154) for return to conditioning plenum 46 and recirculation by blowers 50, 52.

In the cooking of meat products, combustibles such as grease are deposited on the water in the reservoir chambers 82 while rising vapors condense on the surfaces of the sealed chamber units. In the periodic cleaning of the oven, (which may be daily in the case of cooking of meat products such as beef or poultry), the sealed chamber units 64, 66 are easily removed by releasing the clamp assemblies. Other interior surfaces of the oven are cleaned with the use of a caustic detergent solution that is sprayed into the housing and drained into the flow channel 94 at the bottom of the housing.

While a particular embodiment of the invention has been shown and described, various modifications will be apparent to those skilled in art, and therefore it is not intended that the invention be limited to the disclosed embodiment or to details thereof, and departures may be made therefrom within the spirit and scope of the invention.

What is claimed is:

1. A thermal treatment system comprising thermally insulated housing structure, conditioning plenum structure disposed in said housing structure, distribution plenum structure disposed in said housing structure and coupled to said conditioning plenum structure, said distribution plenum structure being disposed adjacent a treatment zone that extends through said housing structure, the side of said distribution plenum structure adjacent said treatment zone defining an open port region that corresponds in dimension to the length and width of said treatment zone, bounded by seal flange structure extending along the edges of said open port region, conveyer structure for supporting product to be thermally treated disposed in said treatment zone in juxtaposition to said open port region of said distribution plenum structure, means for moving said conveyer structure to transport products to be treated through said treatment zone, a series of sealed chamber units, each said sealed chamber unit including peripheral wall structure and upper and lower tube sheet structure that are sealed to said peripheral wall structure, and an array of nozzle tubes sealed to and extending between said upper and lower tube sheet structures to provide an array of spaced parallel flow passages through said sealed chamber, said series of sealed chamber units being disposed along said open port region of said distribution plenum structure and closing said open port region so that said series of sealed chamber units define a wall of said distribution plenum structure adjacent said treatment zone, releasable structure for seating said sealed chamber units on said distribution plenum flange surfaces to provide seals between said sealed chamber units and said distribution plenum seal flanges, and means for flowing conditioned gas from said conditioning plenum structure into said distribution plenum structure for discharge with substantial velocity toward said conveyer through the nozzle tubes of said sealed chamber units for thermal treatment of products being transported by said conveyer structure through said treatment zone.

2. The system of claim 1 wherein the ends of the tubes of each said sealed chamber unit are substantially flush with the respective tube sheet structures.

3. The system of claim 1 wherein one end of each tube is flush with a tube sheet structure and the other end of each tube projects beyond the other tube sheet, and further including wall structure surrounding said projecting ends of said tubes for providing a reservoir region for containment of liquid adjacent said treatment zone.

4. The thermal treatment system of claim 3 and further including water supply manifold structure extending along one side of said treatment zone along the length thereof, a plurality of flow passages for transferring water from said distribution manifold to corresponding reservoirs of sealed chamber units, and wherein each said sealed chamber unit includes overflow weir structure for discharge of water, and associated transfer structure for transferring said discharge water to waste.

5. The system of claim 1 wherein said seal flange structure extends along the sides of said open region, and each said sealed chamber unit extends across the width of said open region, and is seated on sealed surfaces on opposite sides of said open port region so that a series of sealed chamber units are disposed along the length of said treatment zone and provide a boundary wall of said distribution plenum adjacent said treatment zone in juxtaposition with said conveyer structure.

6. The system of claim 5 wherein said peripheral wall and tube sheet structures of each said sealed chamber unit are of stainless steel sheet, said upper and lower tube sheet structures are welded to said peripheral wall, and said nozzle tubes are welded to said upper and lower tube sheet structures so that a sealed enclosure is maintained, and said nozzle tubes have a length that is at least four times their transverse inner flow dimension (inner diameter), and the center to center spacing of said tubes is between two and eight times said inner flow dimension.

7. The system of claim 6 and further including port structure in peripheral walls of said sealed chamber units for flowing liquid into said chambers.

8. The system of claim 1 wherein said releasable structure include clamp structure coupled between a wall of said distribution plenum structure and said sealed chamber units, and each said sealed chamber unit includes handle structure for manipulation of the sealed chamber unit.

9. The system of claim 8 wherein said nozzle tubes have a length that is at least four times their transverse inner flow dimension (inner diameter), and the center to center spacing of said tubes is between two and eight times said inner flow dimension.

10. The system of claim 9 and further including port structure in peripheral walls of said sealed chamber units for flowing liquid into said chambers.

11. A thermal treatment system comprising thermally insulated housing structure, conditioning plenum structure disposed in said housing structure, first and second distribution plenum structures disposed in said housing structure and coupled to said conditioning plenum structure, each said distribution plenum structure being disposed adjacent a treatment zone that extends through said housing structure, the side of each said distribution plenum structure adjacent said treatment zone defining an open port region that corresponds in dimension to the length and width of said treatment zone, each said open port region being bounded by seal flange structure extending along the edges of said open port regions, conveyer structure for supporting product to be thermally treated disposed in said treatment zone in juxtaposition to said open port regions of said distribution plenum structures, means for moving said conveyer structure to transport products to be treated through said treatment zone, first and second series of sealed chamber units, each said sealed chamber unit including peripheral wall structure and upper and lower tube sheet structure that are sealed to said peripheral wall structure, and an array of nozzle tubes sealed to and extending between said upper and lower tube sheet structures to provide an array of spaced parallel flow passages through said sealed chamber, said first series of sealed chamber units being disposed along said open port region of said first distribution plenum structure and closing said open port region so that said series of sealed chamber units define a wall of said first distribution plenum structure adjacent said treatment zone, said second series of sealed chamber units being disposed along said open port region of said second distribution plenum structure and closing said open port region so that said series of sealed chamber units define a wall of said second distribution plenum structure adjacent said treatment zone, releasable clamp structure for seating said sealed chamber units on said distribution plenum flange surfaces to provide seals between said sealed chamber units and said distribution plenum seal flanges, and means for flowing conditioned gas from said conditioning plenum structure into said distribution plenum structures for discharge with substantial velocity toward said conveyer through the nozzle tubes of said sealed chamber units for thermal treatment of products being transported by said conveyer structure through said treatment zone.

12. The system of claim 11 wherein the ends of the tubes of each said first sealed chamber unit are substantially flush with the respective tube sheet structures, and one end of each tube of each said second sealed chamber unit is flush with a tube sheet structure and the other end of each tube of each said second sealed chamber unit projects beyond the other tube sheet, and wherein each said second sealed chamber unit further includes wall structure surrounding said projecting ends of said tubes for providing a reservoir region for containment of liquid adjacent said treatment zone.

13. The system of claim 11 wherein said releasable structure include clamp structure coupled between a wall of each said distribution plenum structure and said sealed chamber units, and each said sealed chamber unit includes handle structure for manipulation of the sealed chamber unit.

14. The system of claim 11 and further including water supply manifold structure extending along one side of said treatment zone along the length thereof, a plurality of flow passages for transferring water from said distribution manifold to corresponding reservoirs of said second series of sealed chamber units, and wherein each said second sealed chamber unit includes overflow weir structure for discharge of water, and associated transfer structure for transferring said discharge water to waste.

15. The system of claim 11 wherein said peripheral wall and tube sheet structures of each said sealed chamber unit are of stainless steel sheet, said upper and lower tube sheet structures are welded to said peripheral wall, and said nozzle tubes are welded to said upper and lower tube sheet structures so that a sealed enclosure is maintained, said nozzle tubes have a length that is at least four times their transverse inner flow dimension, and the center to center spacing of said tubes is between two and eight times said inner flow dimension.

16. The system of claim 15 wherein said seal flange structure extends along the sides of said open region of each said distribution plenum, and each said sealed chamber unit extends across the width of said open region, and is seated on sealed surfaces on opposite sides of said open port region so that a series of sealed chamber units is disposed along the length of said treatment zone above and below said treatment zone and provide boundry walls of said distribution plenums adjacent said treatment zone parallel to and in juxtaposition with the path of said conveyer structure in said housing.

17. The system of claim 16 wherein the ends of the tubes of each said first sealed chamber unit are substantially flush with the respective tube sheet structures, and one end of each tube of each said second sealed chamber unit is flush with a tube sheet structure and the other end of each tube of each said second sealed chamber unit projects beyond the other tube sheet, and wherein each said second sealed chamber unit further includes wall structure surrounding said projecting ends of said tubes for providing a reservoir region for containment of liquid adjacent said treatment zone.

18. The system of claim 17 wherein said releasable structure include clamp structure coupled between a wall of each said distribution plenum structure and said sealed chamber units, and each said sealed chamber unit includes handle structure for manipulation of the sealed chamber unit.

19. The system of claim 18 and further including water supply manifold structure extending along one side of said treatment zone along the length thereof, a plurality of flow passages for transferring water from said distribution manifold to corresponding reservoirs of said second series of sealed chamber units, and wherein each said second sealed chamber unit includes overflow weir structure for discharge of water, and associated transfer structure for transferring said discharge water to waste.

* * * * *